US006666192B2

(12) United States Patent
Rodriguez et al.

(10) Patent No.: US 6,666,192 B2
(45) Date of Patent: Dec. 23, 2003

(54) FLUID CONTROL VALVE AND SYSTEM

(75) Inventors: Lorenzo G. Rodriguez, El Paso, TX (US); Jose I. Velazquez, Hermosillo (MX); Carlos E. Almeida, El Paso, TX (US)

(73) Assignee: Delphi Technologies, Inc., Troy, MI (US)

( * ) Notice: Subject to any disclaimer, the term of this patent is extended or adjusted under 35 U.S.C. 154(b) by 85 days.

(21) Appl. No.: 09/993,360

(22) Filed: Nov. 14, 2001

(65) Prior Publication Data

US 2003/0089344 A1 May 15, 2003

(51) Int. Cl.[7] ..... F02M 33/02
(52) U.S. Cl. ..... 123/520; 251/129.15
(58) Field of Search ..... 123/520, 519, 123/518, 516, 198 D; 251/129.15; 137/625.25

(56) References Cited

U.S. PATENT DOCUMENTS

| | | | | |
|---|---|---|---|---|
| 3,678,910 A | | 7/1972 | Marlett | |
| 4,026,258 A | | 5/1977 | Ino et al. | |
| 4,830,333 A | | 5/1989 | Watson | |
| 4,901,702 A | | 2/1990 | Beicht et al. | |
| 5,102,054 A | | 4/1992 | Halvorsen | |
| 5,161,511 A | | 11/1992 | Ketterer | |
| 5,284,121 A | | 2/1994 | Abe et al. | |
| 5,460,137 A | | 10/1995 | Zabeck et al. | |
| 5,630,403 A | | 5/1997 | Van Kampen et al. | |
| 5,970,958 A | * | 10/1999 | DeLand et al. | 123/520 |
| 5,996,559 A | * | 12/1999 | Busato et al. | 123/520 |
| 6,058,913 A | | 5/2000 | Busato et al. | |
| 6,463,951 B2 | | 10/2002 | Shost | 137/15.18 |
| 6,467,495 B2 | | 10/2002 | Shost | 137/15.18 |
| 2003/0030018 A1 | | 2/2003 | Burrola et al. | 251/129.15 |

FOREIGN PATENT DOCUMENTS

| | | |
|---|---|---|
| DE | 42 29 110 C1 | 10/1993 |
| EP | 0 585 527 A1 | 3/1994 |
| EP | 1069304 A2 | 1/2001 |
| GB | 1 516 953 | 7/1978 |
| JP | 08014136 | 1/1996 |

* cited by examiner

*Primary Examiner*—Mahmoud Gimie
(74) *Attorney, Agent, or Firm*—Jimmy L. Funke

(57) ABSTRACT

Disclosed herein is a fluid control valve comprising a valve seat, and a nozzle proximate the valve seat. The nozzle includes a convergent section and a divergent section formed by a semi-circular profile. Also disclosed herein is a system for controlled feeding of volatile fuel components from a free space of a fuel tank to an engine manifold, the system comprising a storage chamber in fluid communication with the free space of the fuel tank, and a valve in fluid communication between the storage chamber and the engine manifold. The valve includes a valve seat and a nozzle proximate the valve seat. The nozzle includes a convergent section and a divergent section formed by a semi-circular profile.

25 Claims, 4 Drawing Sheets

FLUID CONTROL VALVE AND SYSTEM

BACKGROUND

The present disclosure generally relates to fluid control valves and systems. Fluid control valves may be used in systems for the controlled feeding of volatile fuel components present in the free space of a fuel tank into an intake manifold of an internal combustion engine. A system of this type is disclosed U.S. Pat. No. 4,901,702. The system includes a vent line connecting the free space to the atmosphere. In the vent line there is disposed a storage chamber containing an absorption element, as well as a line connecting the storage chamber to the intake tube, which can be shut off by an electromagnetic check valve. Between the check valve and the intake tube there is disposed an auxiliary valve with a control chamber. The auxiliary valve can be closed by a vacuum actuator in dependence upon the pressure difference between the control chamber and the atmosphere. During low engine operating speeds in the near idling range, the flow rate of volatile fuel components through the apparatus is reduced so as to prevent the excessive enrichment of the mixture fed to the engine; at high engine operating speeds when the differential pressure between the engine and the tank is reduced, the non-return valve employed is wide open.

Another system of this type is disclosed in U.S. Pat. No. 5,284,121. This system comprises a pneumatically actuated purge control valve for opening or closing a flow line which connects an upper space of the fuel tank with the intake pipe, a controller for controlling the operation of the valve, a throttle section formed in series with the purge control valve, and pressure and temperature sensors which are located on the upstream side of the throttle section for detecting a pressure and a temperature of the evaporated fuel. When a value detected by the pressure sensor exceeds a predetermined value of pressure for providing a critical pressure ratio at which a flow rate of the evaporated fuel at the throttle section substantially equals to a sonic velocity, the controller opens the pneumatically actuated purge control valve to cause a purged flow of the evaporated fuel whose flow rate is constant. Simultaneously, the controller calculates a purged flow rate of the evaporated fuel from the detected values of the pressure and temperature sensors and a time period during which the purge control valve is opened. On the basis of the calculated purged flow rate, a reduction correction is made to an amount of the fuel to be supplied to the engine in order to maintain an air-fuel ratio in the optimum condition.

U.S. Pat. No. 5,460,137 provides another system of this type. This system includes a venting line that connects the free space of the fuel tank to the atmosphere. Along this line is interposed a storage chamber containing an absorption element having at least one line which connects the storage chamber to the intake manifold and which can be sealed by an electromagnetically actuated valve. The valve includes a seat and a Laval-type nozzle arranged downstream of the seat. The Laval-type nozzle allows the valve to employ a valve seat having a relatively small orifice cross section while maintaining generally the same mass throughput as a valve employing a relatively large valve seat with a standard cylindrical nozzle. The relatively small orifice cross section allows the valve to employ relatively small actuating forces to open and close the valve, thereby allowing the valve to be held in the closed position during clocked control for a longer period of time so that the excessive enrichment of the fuel-air mixture can be avoided.

SUMMARY

Disclosed herein is a fluid control valve comprising a valve seat and a nozzle proximate the valve seat. The nozzle includes a convergent section and a divergent section formed by a semi-circular profile.

Also disclosed herein is a system for controlled feeding of volatile fuel components from a free space of a fuel tank to an engine manifold. The system comprises a storage chamber in fluid communication with the free space of the fuel tank, and a valve in fluid communication between the storage chamber and the engine manifold. The valve includes a valve seat and a nozzle proximate the valve seat. The nozzle includes a convergent section and a divergent section formed by a semi-circular profile.

The above described and other features are exemplified by the following figures and detailed description.

BRIEF DESCRIPTION OF THE DRAWINGS

Referring now to the figures, which are exemplary embodiments, and wherein the like elements are numbered alike.

DETAILED DESCRIPTION

Figure 1:
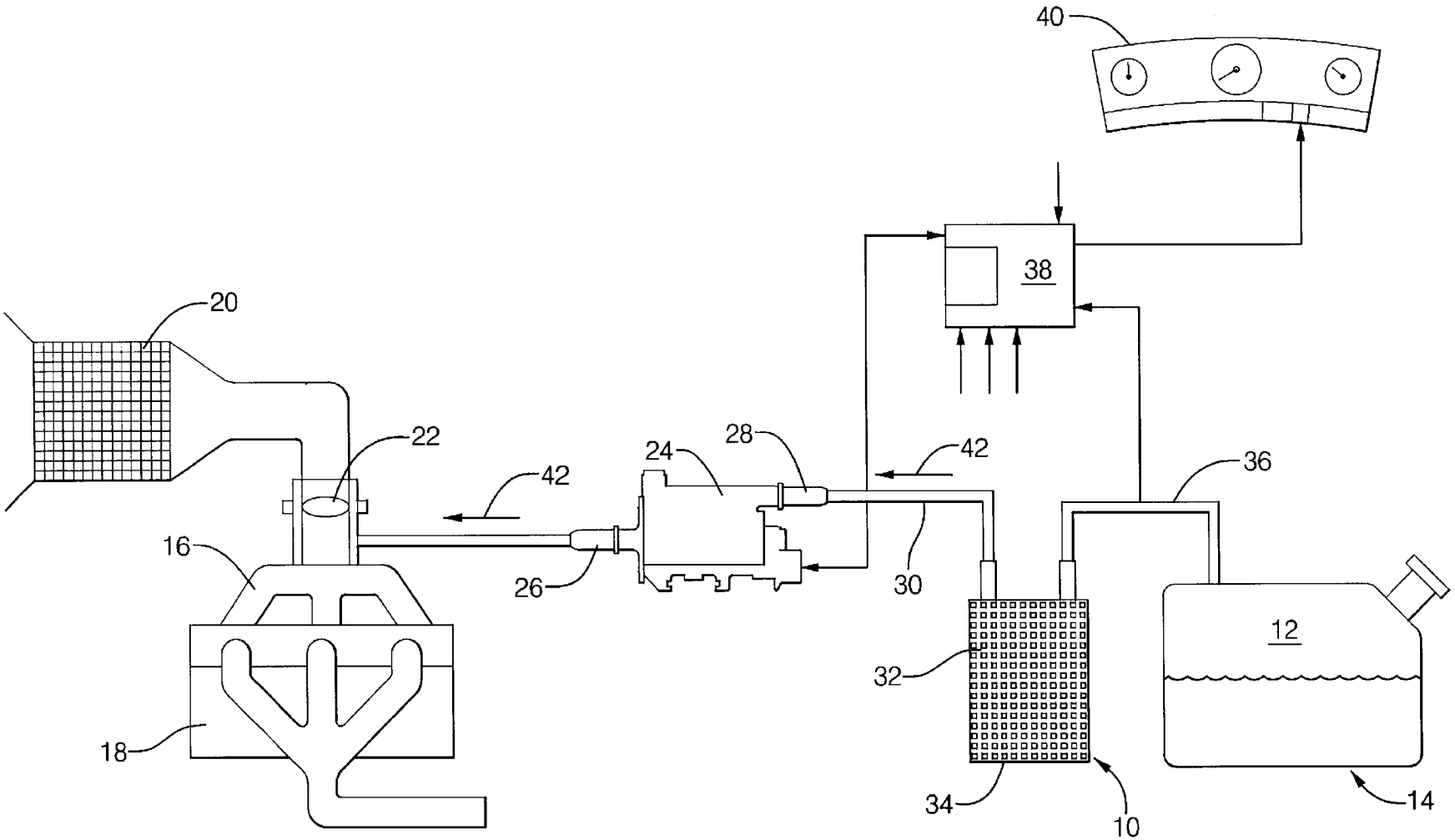
FIG. 1 is a schematic view of an exemplary system for the controlled feeding of volatile fuel components from the free space of a fuel tank to an engine manifold.

Referring to FIG. 1, an exemplary embodiment of a system 10 for the controlled feeding of volatile fuel components from a free space 12 of a fuel tank 14 to an intake manifold 16 of an internal combustion engine 18 is shown. The system 10 includes an air filter 20 and a throttle valve 22, which may be located inside the intake manifold 16. System 10 also includes a fluid control valve 24 having an outlet port 26 in fluid communication with intake manifold 16 and an inlet port 28 in fluid communication with an outlet 30 of an absorption element 32. Absorption element 32 is located within a storage chamber 34, and may be an activated carbon filter or the like. An inlet 36 of absorption element 32 is in fluid communication with the free space 12 of fuel tank 14 and with a diagnostic unit 38. Diagnostic unit 38 is in electrical communication with fluid control valve 24 and may in communication with the indicating instruments 40.

During the operation of the internal combustion engine 18, volatile fuel components from the free space 12 of the fuel tank 14 pass into the storage chamber 34 via the inlet 36 of absorption element 32 and are taken up by the absorption element 32. Vacuum in the intake manifold 16 of the internal combustion engine 18 draws the volatile fuel components from chamber 34 through the outlet 30 of absorption element 32 and through the fluid control valve 24. The volatile fuel components are fed from fluid control valve 24 to the manifold 16 in the flow direction 42 towards the throttle valve 22. The flow of volatile fuel components from chamber 34 to the intake manifold 16 can be sealed by fluid control valve 24.

Fluid control valve 24 is controlled (i.e., opened and closed) in response to various signals received from diagnostic unit 38. The Diagnostic unit 38 monitors various environmental and vehicle variables to estimate the amount of fuel vapors stored in the absorption element 32. The diagnostic unit 38 serves to monitor and control the fluid control valve 24. The passage of volatile fuel components into the intake manifold 16 is regulated as a function of input variables such as the position of the throttle valve 22, the speed of rotation of the internal combustion engine 18, and/or the composition of the exhaust gas.

Figure 2:
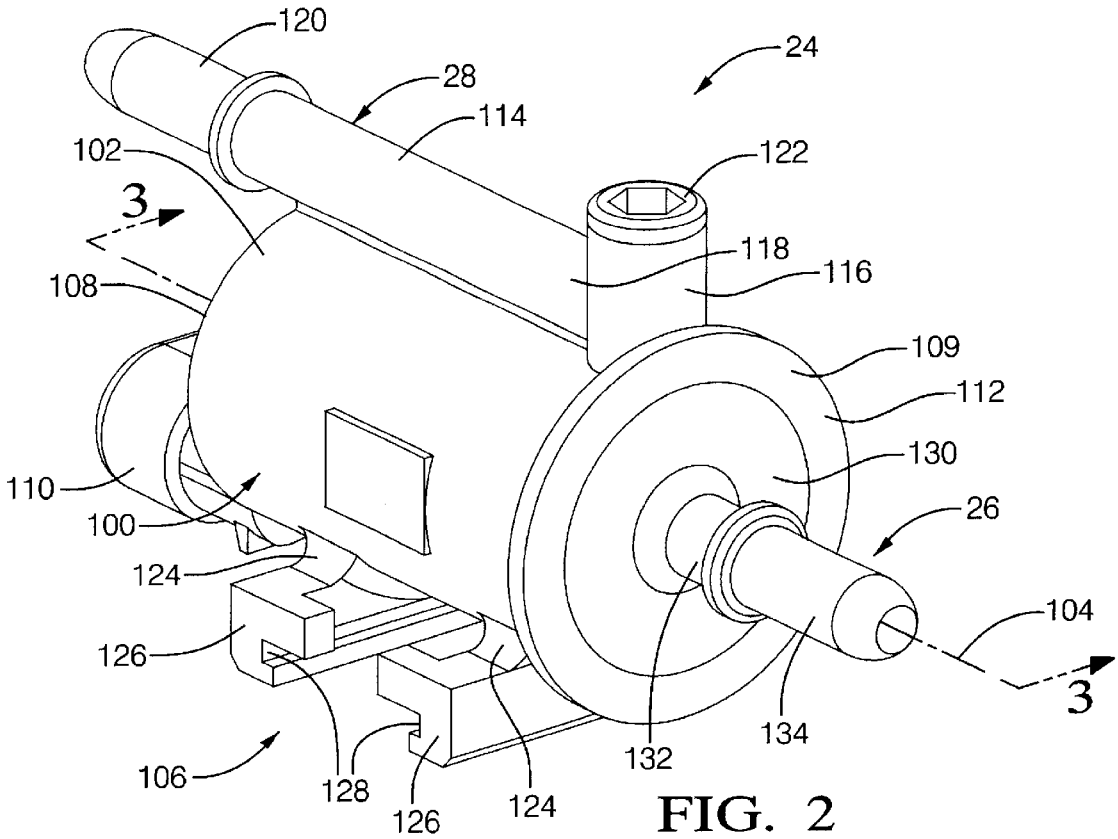
FIG. 2 is a perspective view of the fluid control valve of FIG. 1.

Referring to FIG. 2, a perspective view of an exemplary embodiment of the fluid control valve 24 is shown. Fluid control valve 24 includes a housing 100 that is, preferably, cylindrical in shape and molded from plastic. Inlet port extends along a radial surface 102 of housing 100, generally parallel to a longitudinal axis 104 of the outlet port 26. Also extending from radial surface 102, diametrically opposite inlet port 28, is a mounting bracket 106. Extending from an end surface 108 of housing 100 is a terminal housing 110. An opposite end surface 112 of housing 100 is formed in part by a flange 109 that extends outward from radial surface 102. Outlet port 26 is received within an aperture formed by flange 109.

Inlet port 28 includes a first tubular section 114 that extends generally parallel to longitudinal axis 104, and a second tubular section 116 that extends generally perpendicular to longitudinal axis 104. Second tubular section 116 is attached to first tubular section 114 at an end 118 of first tubular section 114 proximate end surface 112 of housing 100. An end 120 of first tubular section 114 proximate end surface 108 of housing is configured to receive tubing from system 10 (e.g., tubing from outlet 30 of absorption element 32 as shown in FIG. 1). Second tubular section 116 includes a plug 122 disposed in an end thereof. Plug 122 seals the end of second tubular section 116 to prevent the volatile fuel components from escaping as they pass through first tubular section 114 and second tubular section 116 into housing 100. Preferably, inlet port 28 is integrally molded with housing 100.

Mounting bracket 106 includes two legs 124 that extend from radial surface 102. Each leg 124 includes a generally "C" shaped guide 126 formed on an end of leg 124 distal from radial surface 102. The "C" shaped guides 126 include slots 128 that are arranged in opposition to each other, such that a mounting plate (not shown) may be slidably received within slots 128 to secure fluid control valve 24 to the mounting plate. Preferably, mounting bracket 106 is integrally molded with housing 100.

Terminal housing 110 is configured to retain an electrical terminal (not shown) for electrically coupling fluid control valve 24 and diagnostic unit 38 (FIG. 1). Preferably, terminal housing 110 is integrally molded with housing 100.

Outlet port 26 includes a generally flat, circular end cap 130 and a nozzle portion 132 that extends from end cap 130 along longitudinal axis 104. A free end 134 of nozzle portion 132 is configured to receive tubing from system 10 (e.g., tubing to inlet manifold 16 as shown in FIG. 1).

Figure 3:
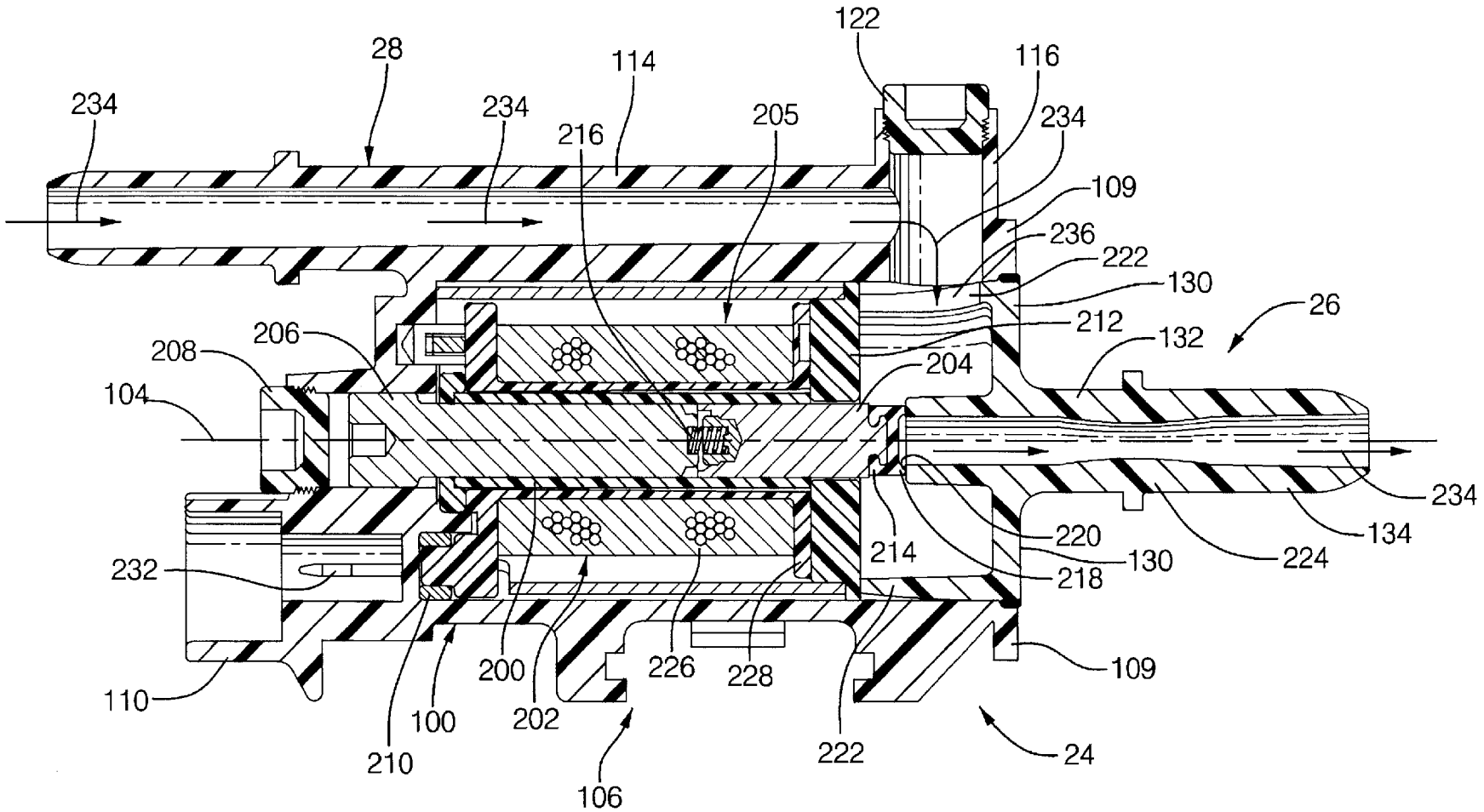
FIG. 3 is a cross-sectional view of the fluid control valve of FIG. 2.

Referring to FIG. 3, a cross-sectional view of fluid control valve 24 is shown. Received in housing 100 is a tubular guide 200 around which a coil winding assembly 202 is disposed. The tubular guide 200 slidably supports a valve plunger 204 that is formed of a ferrous material (e.g., steel). Valve plunger 204 and coil winding assembly 202 form an actuator 205 for opening and closing fluid control valve 24. Also extending within tubular guide 200 is a stop member 206, which is prevented from axial movement by frictional engagement with housing 100 or by mechanical engagement with an end cap 208 disposed in housing 100. Tubular guide 200 is retained at one end by a spacer 210, which abuts housing 100, and the other end of tubular guide 200 is retained by an annular wall 212. Valve plunger 204 extends through an aperture in annular wall 212.

Disposed on one end of valve plunger 204 is a sealing device 214. Disposed on the opposite end of valve plunger 204 is a spring 216, which extends between valve plunger 204 and stop member 206. Spring 216 biases valve plunger 204 towards outlet port 26. In the embodiment shown, sealing device 214 is a resilient stopper including a lip 218 extending axially from its periphery. In the closed position of fluid control valve 24, as shown in FIG. 3, spring 216 forces sealing device 214, via valve plunger 204, into contact with a valve seat 220 formed on outlet port 26, thus preventing the flow of volatile fuel components through valve 24. While sealing device 214 is shown here as a resilient stopper including lip 218, it will be recognized that sealing device 214 may include a resilient stopper having a flat sealing surface (e.g., without lip 218). Alternatively, sealing device 214 may include a surface formed on valve plunger 204, or any device that interfaces with valve seat 220 to form a fluid-tight seal.

Outlet port 26 includes a flange 222 extending axially from the periphery of end cap 130, and nozzle portion 132, which extends through end cap 130. Preferably, flange 222, end cap 130 and nozzle portion 132 are integrally molded. End cap 130 is received within the circular opening formed by flange 109 of housing 100 to form a generally flat, coplanar surface with flange 109. Valve seat 220 is formed on a generally flat end surface of nozzle portion 132. The inside surface of nozzle portion 132 is shaped to form a nozzle 224, as will be described in further detail hereinafter.

Coil winding assembly 202 includes a plurality of wire turns (windings) 226 disposed around a coil bobbin 228. Coil winding assembly 202 is retained at one end by annular wall 212 and at an opposite end by the inside wall of housing 100. The windings 226 are electrically coupled to a terminal 232 mounted within terminal housing 110. The flow of current through windings 226 induces a magnetic force on valve plunger 204, causing valve plunger 204 to move towards stop member 206, against the force of spring 216, thereby separating sealing device 214 from valve seat 220 and placing fluid control valve 24 in an open position.

In the open position, volatile fuel components can flow past sealing device 214 and valve seat 220. The fluid path through fluid control valve is indicated by arrows 234, and extends from inlet port 28 through a notch 236 disposed in flange 222 into a chamber formed by flange 222, end cap 130, and annular wall 212. From this chamber, fluid passes between the sealing device 214 and valve seat 220 (when valve 24 is open) into the nozzle portion 132, where the fluid passes through the nozzle 224 and out of fluid control valve 24.

During use, the windings 226 are supplied with a pulse-width modulated direct current having a variably duty cycle. This causes the fluid control valve 24 to open and close at the frequency of the pulse-width modulated direct current, and the relative time periods that the valve is open and closed depends on the duty cycle. This is known as "pulse width modulated control". As the duty cycle increases, the amount or volume of flow per unit time will increase and vice versa.

Figure 4:
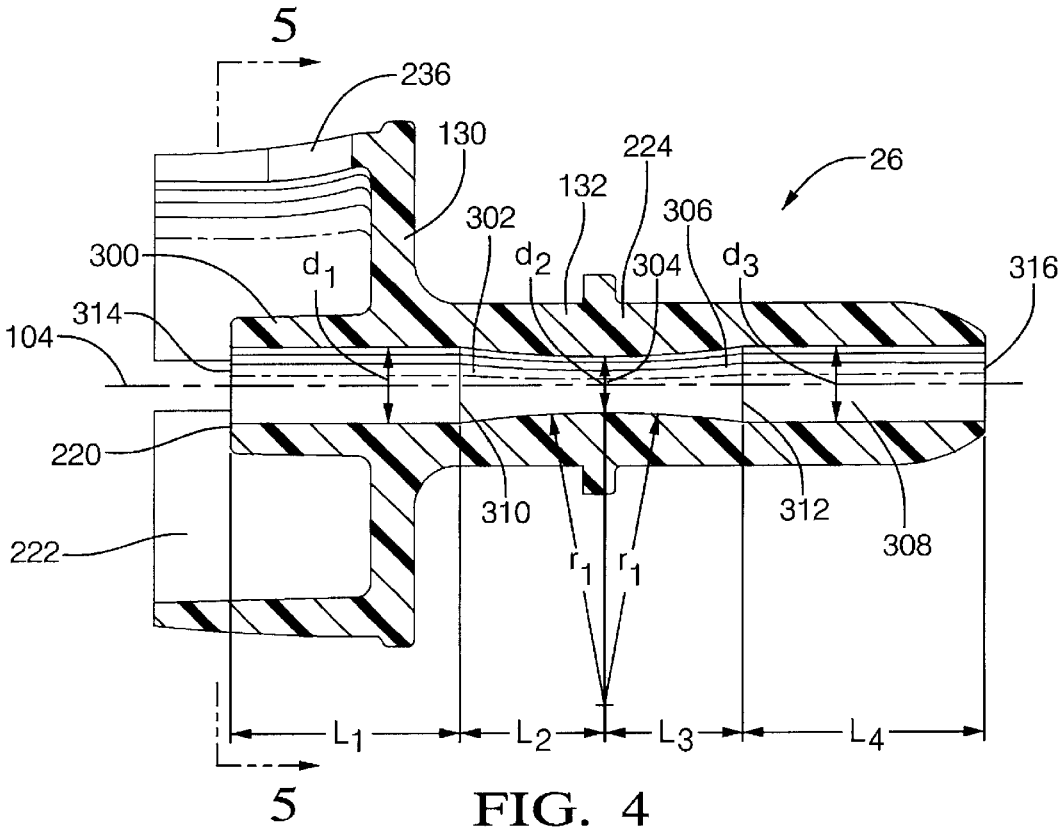
FIG. 4 is a cross-sectional view of the outlet port of FIG. 3.
Figure 5:
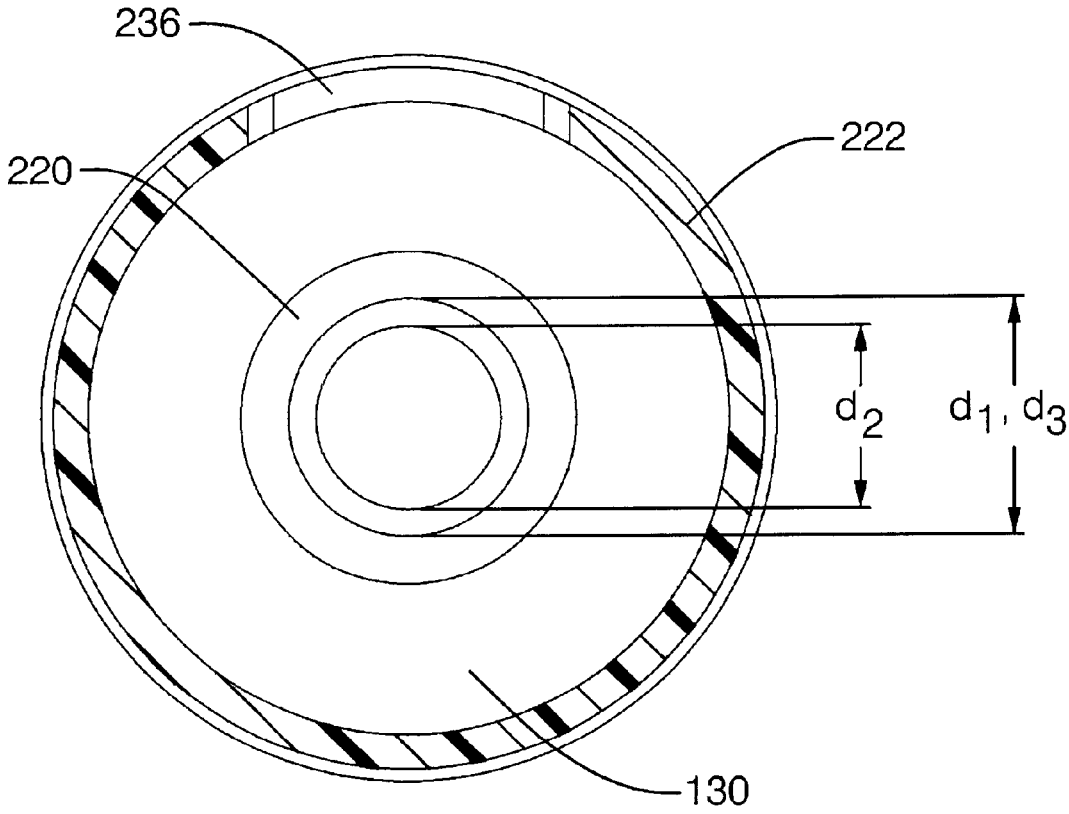
FIG. 5 is another cross-sectional view of the outlet port of FIG. 3.

Referring to FIG. 4 and FIG. 5, FIG. 4 is a longitudinal section of outlet port 26, as indicated at 4—4 in FIG. 5, and FIG. 5 is a transverse section of outlet port 26, as indicated at 5—5 in FIG. 4. As shown in FIG. 4 and FIG. 5, nozzle 224 includes, in the direction of fluid flow, a cylindrical entrance section 300, a convergent section 302, a throat 304, a divergent section 306, and a cylindrical exit section 308. Cylindrical entrance section 300 has a diameter $d_1$, which extends perpendicular to longitudinal axis 104, and a length $L_1$, which is measured along longitudinal axis 104. Cylindrical exit section 308 has a diameter $d_3$, which extends perpendicular to longitudinal axis 104, and a length $L_4$, which is measured along longitudinal axis 104. In the present embodiment, diameter $d_1$ is equal to diameter $d_3$, and length $L_1$ is smaller than or equal to length $L_4$. It will be recognized, however, that the diameters $d_1$ and $d_3$ and the lengths $L_1$ and $L_2$ may be varied as needed for a specific application. Preferably, $L_1$ is selected to prevent the turbulence created by the flow bending 90 degrees at the valve seat entrance from extending into the convergent section 302. Preferably, $L_1$ is selected to have laminar flow in the convergent portion of the semi-circular profile restriction.

Within convergent section 302, the inside diameter of the nozzle 224 decreases from the diameter $d_1$ at the cylindrical entrance section 300 to a diameter $d_2$ at the throat 304, over a length $L_2$, as measured along longitudinal axis 104. As shown in FIG. 4, the profile of the convergent section 302, from diameter $d_1$ to diameter $d_2$, is formed by a radius $r_1$. Within divergent section 306, the inside diameter of the nozzle 224 increases from the diameter $d_2$ at the throat 304 to the diameter $d_3$ at the cylindrical exit section 308, over a length $L_3$, as measured along longitudinal axis 104. The profile of the divergent section 306, from diameter $d_2$ to diameter $d_3$, is formed by the radius, $r_1$. Thus, the convergent and divergent sections 302 and 304, are formed by a semi-circular profile having a radius $r_1$. The throat 304 is the cross sectional flow area at the apex of this semi-circular profile. Throat 304 has a diameter $d_2$, which is less than $d_1$ and $d_3$.

The transition between cylindrical entrance section 300 and convergent section 302, as indicated at 310, and the transition between divergent section 306 and cylindrical exit section 308, as indicated at 312, may be blended to prevent fluid turbulence in these regions. Similarly, edges at inlet and outlet cross sections 314 and 316 of nozzle 224 may be radiused to prevent fluid turbulence in these regions.

The throat diameter $d_2$ is selected based on the maximum required flow through the fluid control valve 24. For example, referring to FIG. 1 and FIG. 4, throat diameter $d_2$ may be selected to set the maximum flow of volatile fuel components through valve 24 required by the application at the relatively high differential pressures existent during idle operation of internal combustion engine 18.

After the diameter $d_2$ is selected, the diameter $d_1$ is then selected to insure that the nozzle will have enough flow to allow for choked flow at the lower differential pressures existent during wide throttle operation of internal combustion engine 18. Preferably, diameter $d_1$ can be greater than or equal to about 1.2 times diameter $d_2$. More preferably, $d_1$ can be greater than or equal to about 1.4 times diameter $d_2$. The maximum dimension of $d_1$ may be set to insure that the smallest force available to open valve 24 (e.g., the magnetic force induced by windings 226 on valve plunger 204) is greater than the maximum vacuum force on the sealing device 214 (FIG. 3).

The radius $r_1$ is then selected to insure that the convergent, divergent semi-circular profile will create a choked flow at low vacuum levels. The radius $r_1$ may also be selected to accommodate $d_1$, $d_2$, and $L_1$ in the space available for nozzle 224. That is, the radius $r_1$ may be selected to insure that the semi-circular profile creates a convergent section 302 wherein the diameter decreases from $d_1$ to $d_2$, and to insure that the lengths $L_1$, $L_2$, and $L_3$ fit within the overall length available for nozzle 224. For the application described herein, the radius $r_1$ can be less than or equal to about 100 millimeters, with less than or equal to about 64 millimeters preferred. Also for the application described herein, the radius $r_1$ can be greater than or equal to about 5 millimeters, with greater than about 9.6 millimeters preferred.

Rather than employing a Laval-type or Venturi-type nozzle, valve 24 employs a relatively simple nozzle design. Nozzle 224 employs a semi-circular profile to form the convergent and divergent sections of the nozzle. Use of the semi-circular profile allows the nozzle to be designed without regard for the angles of the convergent and divergent sections, which must be considered in the design of a Laval-type or a Venturi-type nozzle. In addition, because the angles of the convergent and divergent sections are not important in manufacturing tolerance considerations, manufacturing of a valve 24 including the nozzle 224 is simplified from that possible with valves including nozzles of the Laval-type or Venturi-type.

While the invention has been described with reference to an exemplary embodiment, it will be understood by those skilled in the art that various changes may be made and equivalents may be substituted for elements thereof without departing from the scope of the invention. For example, while nozzle 224 is described herein as being used in a fluid control valve 24 employing an electromagnetic actuator 205, it will be appreciated that nozzle 224 may be used in a fluid control valve 24 employing a pneumatic actuator such as that described in U.S. Pat. No. 5,284,121. In another example, while inlet port is described herein as extending parallel to longitudinal axis 104, it will be appreciated that inlet port may extend at an angle to longitudingal axis 104, such as described in U.S. Pat. No. 4,830,333. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A fluid control valve comprising:

a valve seat;

a nozzle proximate said valve seat, said nozzle including a convergent section and a divergent section being formed by an arcuate profile being defined by a radius, wherein said radius is greater than or equal to about 5 millimeters.

2. The fluid control valve of claim 1, wherein said nozzle further includes:

a cylindrical entrance section in fluid communication with said convergent section.

3. The fluid control valve of claim 1, wherein said nozzle further includes:

a cylindrical exit section in fluid communication with said divergent section.

4. The fluid control valve of claim 1, wherein said nozzle further includes:

a cylindrical entrance section in fluid communication with said convergent section;

a cylindrical exit section in fluid communication with said divergent section; and wherein said cylindrical entrance section and said cylindrical exit section have the same diameter.

5. The fluid control valve of claim 2, wherein said cylindrical entrance section includes an axial length selected to prevent turbulent fluid flow from entering said convergent section.

6. The fluid control valve of claim 1, wherein said radius of said arcuate profile is greater than about 9.6 millimeters.

7. A fluid control valve comprising:

a valve seat;

a nozzle proximate said valve seat, said nozzle including a convergent section and a divergent section being formed by an arcuate profile being defined by a radius, wherein an apex of said arcuate profile forms a throat of said nozzle, said cylindrical entrance section includes a diameter greater than or equal to about 1.2 times a diameter of said throat.

8. The fluid control valve of claim 7, wherein said diameter of said cylindrical entrance section is greater than or equal to about 1.4 times said diameter of said throat.

9. A fluid control valve comprising:

a valve seat;

a nozzle proximate said valve seat, said nozzle including a convergent section and a divergent section being formed by an arcuate profile being defined by a radius, wherein said arcuate profile has a radius less than or equal to about 100 millimeters.

10. The fluid control valve of claim 9, wherein said radius of said arcuate profile is less than or equal to about 64 millimeters.

11. A system for controlled feeding of volatile fuel components from a free space of a fuel tank to an engine manifold, the system comprising:

a storage chamber in fluid communication with the free space of the fuel tank;

a valve in fluid communication between said storage chamber and the engine manifold, said valve including:

an inlet port, an outlet port in fluid communication with said inlet port, said outlet port including:

a valve seat, and a nozzle proximate said valve seat, said nozzle including a convergent section and a divergent section formed by an arcuate profile, a valve plunger including a sealing device disposed on an end thereof, and an actuator in operable communication with said valve plunger for opening and closing a fluid path between said valve seat and said sealing device, wherein said arcuate profile has a radius greater than or equal to about 5 millimeters.

12. The fluid control valve of claim 11, wherein said nozzle further includes:

a cylindrical entrance section in fluid communication with said convergent section.

13. The fluid control valve of claim 12, wherein said cylindrical entrance section includes an axial length selected to prevent turbulent fluid flow from entering said convergent section.

14. A system for controlled feeding of volatile fuel components from a free space of a fuel tank to an engine manifold, the system comprising:

a storage chamber in fluid communication with the free space of the fuel tank;

a valve in fluid communication between said storage chamber and the engine manifold, said valve including:

an inlet port, an outlet port in fluid communication with said inlet port, said outlet port including:

a valve seat, and a nozzle proximate said valve seat, said nozzle including a convergent section and a divergent section formed by an arcuate profile and said nozzle having a cylindrical entrance section in fluid communication with said convergent section, a valve plunger including a sealing device disposed on an end thereof, and an actuator in operable communication with said valve plunger for opening and closing a fluid path between said valve seat and said sealing device, wherein an apex of said arcuate profile forms a throat of said nozzle, said cylindrical entrance section includes a diameter greater than or equal to about 1.2 times a diameter of said throat.

15. The fluid control valve of claim 14, wherein said diameter of said cylindrical entrance section is greater than or equal to about 1.4 times said diameter of said throat.

16. The fluid control valve of claim 12, wherein an apex of said arcuate profile forms a throat of said nozzle having a first diameter, said cylindrical entrance section includes a second diameter, and wherein said first and second diameters are selected to insure that fluid passing through said nozzle during operation of said internal combustion engine will be choked.

17. The fluid control valve of claim 11, wherein said actuator is an electromagnetic actuator.

18. The fluid control valve of claim 11, wherein said nozzle further includes:

a cylindrical exit section in fluid communication with said divergent section.

19. A system for controlled feeding of volatile fuel components from a free space of a fuel tank to an engine manifold, the system comprising:

a storage chamber in fluid communication with the free space of the fuel tank;

a valve in fluid communication between said storage chamber and the engine manifold, said valve including:

an inlet port, an outlet port in fluid communication with said inlet port, said outlet port including:

a valve seat, and a nozzle proximate said valve seat, said nozzle including a convergent section and a divergent section formed by an arcuate profile, a valve plunger including a sealing device disposed on an end thereof, and an actuator in operable communication with said valve plunger for opening and closing a fluid path between said valve seat and said sealing device, wherein said arcuate profile has a radius less than or equal to about 100 millimeters.

20. The fluid control valve of claim 19, wherein said radius of said arcuate profile is less than or equal to about 64 millimeters.

21. The fluid control valve of claim 11, wherein said radius of said arcuate profile is greater than about 9.6 millimeters.

22. The fluid control valve of claim 11, wherein said cylindrical entrance section includes a diameter selected to insure that a force provided by said actuator for opening said fluid path between said valve seat and said sealing device is greater than a vacuum force on said sealing device.

23. A system for controlled feeding of volatile fuel components from a free space of a fuel tank to an engine manifold, the system comprising:

a storage chamber in fluid communication with the free space of the fuel tank;

a valve in fluid communication between said storage chamber and the engine manifold, said valve including:

an inlet port, an outlet port in fluid communication with said inlet port, said outlet port including:

a valve seat, and a nozzle proximate said valve seat, said nozzle including a convergent section and a divergent section formed by an arcuate profile, a valve plunger including a sealing device disposed on an end thereof, and an actuator in operable communication with said valve plunger for opening and closing a fluid path between said valve seat and said sealing device, wherein said nozzle further includes:

a cylindrical entrance section in fluid communication with said convergent section;

a cylindrical exit section in fluid communication with said divergent section; and wherein said cylindrical entrance section and said cylindrical exit section have the same diameter.

24. An outlet port configured for use with a fluid control valve, the outlet port comprising:

a valve seat;

a nozzle proximate said valve seat, said nozzle including a convergent section and a divergent section each being formed by an arc profile being defined by a radius;

a cylindrical entrance section being in fluid communication with said convergent section;

a cylindrical exit section being in fluid communication with said divergent section, wherein an apex of said arc profile forms a throat of said nozzle, said cylindrical entrance section having a diameter equal to a diameter of said divergent section.

25. The outlet port as in claim 24, wherein the diameter of said cylindrical entrance section is greater than or equal to about 1.2 times a diameter of said throat.

* * * * *